US012227997B2

(12) United States Patent
Boulet et al.

(10) Patent No.: US 12,227,997 B2
(45) Date of Patent: Feb. 18, 2025

(54) DOWNHOLE TRACTION TOOL AND METHOD OF USE

(71) Applicant: INNOVATIVE DRILLING SYSTEMS LIMITED, Aberdeen (GB)

(72) Inventors: Jean Boulet, Aberdeen (GB); Siegfried Grabner, Aberdeen (GB)

(73) Assignee: INNOVATIVE DRILLING SYSTEMS LTD, Aberdeen (GB)

( * ) Notice: Subject to any disclaimer, the term of this patent is extended or adjusted under 35 U.S.C. 154(b) by 0 days.

(21) Appl. No.: 17/783,394

(22) PCT Filed: Dec. 9, 2020

(86) PCT No.: PCT/GB2020/053148

§ 371 (c)(1),
(2) Date: Jun. 8, 2022

(87) PCT Pub. No.: WO2021/116675

PCT Pub. Date: Jun. 17, 2021

(65) Prior Publication Data

US 2023/0003089 A1 Jan. 5, 2023

(30) Foreign Application Priority Data

Dec. 9, 2019 (GB) ..... 1917970

(51) Int. Cl.
*E21B 17/22* (2006.01)
*E21B 17/10* (2006.01)

(52) U.S. Cl.
CPC ..... *E21B 17/22* (2013.01); *E21B 17/1078* (2013.01)

(58) Field of Classification Search
CPC ..... E21B 17/22; E21B 17/1078
See application file for complete search history.

(56) References Cited

U.S. PATENT DOCUMENTS 5,649,603 A * 7/1997 Simpson ..... E21B 17/22 175/323
5,954,131 A 9/1999 Sallwasser
6,179,055 B1 1/2001 Sallwasser et al.
6,629,568 B2 10/2003 Post et al.
6,761,233 B1 * 7/2004 Aadland ..... F16L 55/30 175/97

(Continued)

FOREIGN PATENT DOCUMENTS

WO WO2014/067730 A1 5/2014
WO WO2018/151718 A1 8/2018
WO WO2019/053464 A1 3/2019

OTHER PUBLICATIONS

International Search Report dated Mar. 15, 2021 for PCT/GB2020/053148.
Written Opinion dated Mar. 15, 2021 for PCT/GB2020/053148.

*Primary Examiner* — Taras P Bemko
(74) *Attorney, Agent, or Firm* — FisherBroyles, LLP

(57) ABSTRACT

The invention provides a downhole borehole traction apparatus (10) and method of use. The apparatus comprises a body comprising a borehole engaging section wherein the borehole engaging section comprises an outer surface comprising at least one thread. The at least one thread comprises a crest surface (32), a leading surface (30), and a trailing surface (28) having a curvilinear shape. The at least one thread has a low pressure generation means comprising one or more formations.

25 Claims, 12 Drawing Sheets

(56) References Cited

U.S. PATENT DOCUMENTS

| | | | | |
|---|---|---|---|---|
| 2003/0221872 | A1 | 12/2003 | Boulet | |
| 2014/0116779 | A1* | 5/2014 | Fraser | E21B 4/00 175/51 |
| 2014/0158432 | A1* | 6/2014 | Simpson | E21B 17/1057 175/73 |
| 2016/0290067 | A1 | 10/2016 | Tipples et al. | |
| 2019/0345785 | A1* | 11/2019 | Fleckenstein | E21B 23/14 |
| 2019/0368331 | A1* | 12/2019 | Vick, Jr. | E21B 41/00 |
| 2020/0232304 | A1* | 7/2020 | Boulet | E21B 37/10 |

* cited by examiner

DOWNHOLE TRACTION TOOL AND METHOD OF USE

This application is the U.S. National Stage of International Application No. PCT/GB2020/053148, which was filed on Dec. 9, 2020. This application also claims the benefit of the filing date of GB patent application No. 1917970.4 which was filed on Dec. 9, 2019. The contents of both of these applications are hereby incorporated by reference.

The present invention relates to a downhole traction apparatus and more particularly but not exclusively relates to a downhole traction tool to be incorporated in a work string in order to promote downward movement of the work string in a borehole.

BACKGROUND TO THE INVENTION

Hydrocarbon exploration drilling typically involves using a work string having a throughbore deployed from a rig at the surface. The work string comprises a drill bit at its very lowest end and which is rotated from surface by a string of drill pipe. Additional lengths of drill pipe are connected at the upper end of the work string at surface to allow the lower end of the work string to drill deeper into the subterranean earth.

In a conventional vertical bore drilling setup, a drill bit is connected to a drill string made up of tubular members. The weight of the drill string located above the drill bit provides weight on bit (WOB) such that rotation of the drill string in turn rotates the drill bit which penetrates deeper into the earth.

In this arrangement the weight on bit is reduced as the bore deviates from the horizonal. The drill string may lie on the lower side of the bore resulting in friction, drag and wear to the drill string and reducing the force applied to the drill bit.

Downhole tractors are known which are used to convey downhole tools along the borehole in highly deviated wellbore. These devices pull the downhole tool on a cable down the well such as described in U.S. Pat. Nos. 5,954,131, 6,179,055 and 6,629,568.

There are various mechanisms used by traction device such as rollers, wheels or chains which act on the borehole wall to drive the downhole tool along. For example, US2014/158432 discloses a roller for mounting on a downhole apparatus. The roller engages a wall of a borehole or bore-lining tubular and urges the apparatus along the wall of the borehole or bore-lining tubular as the roller rotates on the body.

However, these systems develop small areas of high friction and high-pressure zones with the bore wall which may induce whirling behaviour of the drill string causing forward whirl, backward whirl or intermittent bouncing behaviour and lead to scraping, gouging and damage to the wellbore.

SUMMARY OF THE INVENTION

It is an object of an aspect of the present invention to obviate or at least mitigate the foregoing disadvantages of prior art downhole traction tools.

It is a further object of the present invention to provide a robust and reliable downhole traction tool which can provide a downhole traction force with low friction and enhanced efficiency against the bore wall to mitigate damage to the bore wall.

It is a further object of the present invention to provide a downhole traction tool which can move drill cuttings settled on the lower side of the borehole to enable the traction tool to grip the wellbore and mitigate the risk of drill string whirl.

According to a first aspect of the present invention there is provided a downhole borehole traction apparatus comprising:

a body comprising a borehole engaging section;

wherein the borehole engaging section comprises an outer surface with at least one thread wherein the at least one thread comprises;

a crest surface;

a leading surface; and a trailing surface having a curvilinear shape;

wherein the crest surface and the leading surface are configured to engage an inner surface of the borehole to urge the apparatus along the inner surface of the borehole in response to rotation of the body and/or apparatus.

The crest and leading surface may form a wellbore traction section or zone. Preferably the borehole engaging section comprises a plurality of threads to form a threaded profile or traction profile. The traction profile may be configured to bear against an inner wall or surface of borehole to create a thrusting action to advance the apparatus into the borehole in a downhole direction and/or provide an enhanced weight on bit transfer.

The crest surface may be a generally curve surface or a generally flat surface. The crest surface may be dimensioned to be a maximum outer diameter of the borehole engaging section. The crest surface may be dimensioned to be a maximum outer diameter of the apparatus.

The leading surface may extend downstream of the crest surface. The leading surface may extend at angle that is less than ninety degrees with respect to the crest surface. The leading surface may extend at angle that is less than ninety degrees with respect to the longitudinal axis of the apparatus. The leading surface may extend at angle within the range of 10 to 90 degrees with respect to the longitudinal axis of the apparatus. The leading surface may be located at a level below the level of the crest surface. The leading surface may have a direction angle of less than 90 degrees. The direction angle may be equal to or less than 45 degrees.

The leading surface and/or the trailing surface may have a serpentine or helical cross section. The leading surface and/or the trailing surface may have serpentine or helical shape.

The least one thread may have a low pressure generation means. The low pressure generation means may comprise one or more formations upstream of the trailing surface. The low pressure generation means on each thread may comprise one or more formations located downstream of the leading surface.

By providing a low pressure means, debris and drill cuttings on a bed on the lower surface of the wellbore may be attracted and recirculated which may thoroughly clean or clear the borewall around the apparatus and optimize contact between the traction apparatus and the borewall to provide improved traction. The low pressure means may facilitate enhanced fluid bearing effect between the borewall and the crest and leading surfaces by facilitating flow of fluid free of cuttings particles over the at least one thread.

The at least one thread may comprise a thread root. The low pressure generation means may be located adjacent to the thread root. The thread root may be a minimum outside diameter of the apparatus. The low pressure generation means may be located upstream of the thread root.

The crest and leading surface may be configured to engage the inner surface of the borehole to urge the apparatus along the inner surface of the borehole in response to rotation of the body and/or apparatus.

The outer surface of the borehole engaging section may have an asymmetric outer surface.

The at least one thread may be a screw thread. The borehole engaging section may comprise a continuous screw thread formed from a ridge wrapped around the outer surface of the borehole engaging section in the form of a helix. The borehole engaging section may comprise a screw member having a plurality of helical blades. The threaded profile may be formed from a plurality of helical blades located on the outer surface of the borehole engaging surface. Each blade may form a thread on the threaded profile.

The threaded profile may be located on an outer surface of each helical blade. Each helical blade may have a crest edge or surface and the threaded profile may be located on the blade crest edge or surface.

The downhole borehole traction apparatus may comprise upsets at each longitudinal end which flank the borehole engaging section.

According to a second aspect of the present invention there is provided a downhole borehole traction apparatus comprising:

a body comprising a borehole engaging section;

wherein the borehole engaging section comprises an outer surface comprising at least one thread wherein the at least one thread comprises;

a crest surface;

a leading surface; and a trailing surface having a curvilinear shape;

wherein the at least one thread has a low pressure generation means comprising one or more formations located upstream of the trailing surface.

The one or more formations may be located downstream of the leading surface. Each thread may comprise a thread root. The low pressure generation means may be located adjacent to the thread root. The low pressure generation means may be located upstream of the thread root. The thread root may be a minimum outside diameter of the apparatus.

The at least one thread may comprise a helix angle and/or thread angle of between 10 to 45 degrees. The at least one thread may comprise a helix angle and/or thread angle of between 20 and 30 degrees. The at least one thread may comprise a helix angle in the range of 10 to 30 degrees. The at least one thread comprising a helix angle in the range of 10 to 20 degrees. The at least one thread helical blade may comprise a helix angle of less than 30 degrees.

The at least one thread may comprise a thread height of between 2 to 5 cm. Preferably the at least one thread height is around 2.54 cm (1 inch). The at least one thread may comprise a thread pitch of between 1 to 10 cm. The at least one thread may comprise a thread pitch of between 5.08 cm (2 inch) to 7.62 cm (3 inch).

The thread profile may be located on the surface of the borehole engaging section. The thread profile may be located a surface of the one or blades of the borehole engaging section.

Preferably the borehole engaging section comprises a plurality of threads to form a threaded profile or traction profile. The threaded profile may have between one and five threads or helix in a 360 degrees circumference. The threaded profile may have between two and four threads or helix in a 360 degrees circumference. Preferably the threaded profile has four threads or helix in a 360 degrees circumference.

The helix pitch is equal to the thread pitch multiplied by the number of threads. The maximum outer diameter of the apparatus may range from 12.06 cm (4.75 inch) to 24.13 cm (9.5 inch) depending on the borehole size.

Embodiments of the second aspect of the invention may include one or more features of the first aspect of the invention or its embodiments, or vice versa.

According to a third aspect of the present invention there is provided a downhole borehole traction apparatus comprising:

a body comprising a screw member having a plurality of helical blades;

wherein each helical blade comprises;

a crest surface;

a leading surface; and a trailing surface having a curvilinear shape;

wherein the crest surface and the leading surface are configured to engage the inner surface of the borehole to urge the apparatus along the inner surface of the borehole in response to rotation of the body and/or apparatus.

The plurality of helical blades may be located on the outer surface of the body. The plurality of helical blades may form a threaded profile or traction profile on the outer surface of the body.

The screw member may be configured to engage the inner surface of the borehole to urge the apparatus along the inner surface of the borehole in response to rotation of the body and/or apparatus.

The screw member may be configured to grip and/or contact an inner surface of a borehole to generate thrust to move the apparatus along hole in a generally downhole direction in response to rotation of the body and/or screw member.

The downhole borehole traction apparatus may be configured to rotate about a longitudinal axis of the downhole borehole traction apparatus. The screw member and/or the plurality of helical blades are configured to rotate about a longitudinal axis of the downhole borehole traction apparatus.

The helical blades may comprise a helix angle and/or thread angle of between 10 to 45 degrees. The helical blades may comprise a helix angle and/or thread angle of between 20 and 30 degrees. The helical blades may comprise a helix angle in the range of 10 to 30 degrees. The helical blades comprising a helix angle in the range of 10 to 20 degrees. Each helical blade may comprise a helix angle of less than 30 degrees.

The helical blades may comprise a thread height of between 2 to 5 cm. Preferably the thread height is around 2.54 cm (1 inch). The helical blades may comprise a thread pitch of between 1 to 10 cm. The helical blades may comprise a thread pitch of between 5.08 cm (2 inch) to 7.62 cm (3 inch).

The screw member may have between one and five thread or helix in a 360 degrees circumference. The screw member may have between two and four thread or helix in a 360 degrees circumference. Preferably the screw member has between four thread or helix in a 360 degrees circumference.

The helix pitch is equal to the thread pitch multiplied by the number of threads.

The maximum outer diameter of the apparatus may range from 12.06 cm (4.75 inch) to 24.13 cm (9.5 inch) depending on the borehole size.

The downhole borehole traction apparatus may be connectable to work string. The work string may be a tool string such as drill string. The downhole borehole traction apparatus may comprise a tool joint and/or connector.

The tool joint and/or connector may be located at each longitudinal ends of the body of the downhole borehole traction apparatus. The tool joint and/or connector may be configured to couple to a corresponding tool joint and/or connector of a component of the work string.

The downhole borehole traction apparatus may be a unitary component. The downhole borehole traction apparatus may be devoid of separate moving parts. The downhole borehole traction apparatus may be integral with a work string or integral with a work string component. The downhole borehole traction apparatus may be integral with multiple work string components.

The screw member and/or the helical blades may have a larger diameter than the outer diameter of the work string or other components of the work string to enable the screw member and/or the helical blades to contact a surface of the wellbore.

The work string may be a tool string such as a drill string. The downhole traction apparatus may provide a downward force weight on bit. The downhole traction apparatus may control the weight transfer to the bit. The downhole traction apparatus may provide weight on bit function equivalence.

The outer diameter of the screw member and/or the helical blades may be less than the full gauge of the borehole into which the downhole borehole traction apparatus is to be run.

The outer diameter of the screw member and/or the helical blades may be dimensioned such that an annulus space is provided between the outer surface body including the outer surface of the screw member and/or the helical blades and the inner surface of the borehole.

Each helical blade may have a leading surface and a trailing surface. The leading surface and a trailing surface may flank a crest surface.

The leading surface and the crest surface may form a wellbore traction section on each helical blade. The well bore traction section may be configured to engage with the wellbore to urge the apparatus along the inner surface of the borehole in response to rotation of the body.

A low pressure generation means may be located on the helical blades. A low pressure generation means may be located on each helical blade. The low pressure generation means may be located on the leading surface of each helical blade.

The low pressure generation means may comprise one or more formations provided on the leading surface of each helical blade. The one or more formations may be machined formations. A groove or channel is located between each of the adjacent helical blades. The one or more formations may be configured to generate a region of lower pressure in local downhole fluid due to relative movement occurring between the one or more formation and the local downhole fluid.

The one or more formations may follow a helical direction. The one or more formations may be parallel to the screw member and/or the helical blades. The formation may be configured to create a low pressure zone in a portion of a groove between the helical blades. The low pressure zone may be configured to allow the drill cuttings and debris in the wellbore to be recirculated.

The formation may comprise a key direction angle surface portion of the outer surface of the body being arranged at an angle to a longitudinal axis of the body.

The formation may be a recess, cavity, pocket, concave or convex portion on the leading surface. The leading surface may have a first surface zone and a second surface zone. The shape of the surface zone may form the formation. The formation may be a recess, cavity, pocket, concave or convex portion on the first surface zone of the leading surface. The formation angle is the inclined angle between the first surface zone and a second surface zone. The inclined angle may be selected from the range of 15 degrees and 135 degrees. The inclined angle between the first surface zone and a second surface zone may comprises an inclined angle of between: −15 degrees (negative 15 degrees) and 90 degrees.

The inclined angle between the first surface zone and a second surface zone may comprises an angle of between 35 degrees and 55 degrees. The inclined angle between the first surface zone and a second surface zone may comprises an inclined angle of generally 45 degrees.

The trailing surface may be configured to act as a guide surface to recirculate drill cuttings through the groove. The trailing surface may be located adjacent the low pressure generations means.

The trailing surface may have a tapering or curvilinear convex outer surface along its longitudinal length.

The trailing surface may taper between a relatively small outer diameter at its upstream end which is adjacent to the low pressure generation means to a relatively large outer diameter at its downstream end which is adjacent to the crest surface of an adjacent helical blade.

The low pressure generation means may be located downstream of the blade crest surface.

The trailing surface may comprise one or more grooves or scoops formed on its surface which may be configured to entrain and guide drill cuttings to flow in an upstream to downstream direction.

Embodiments of the third aspect of the invention may include one or more features of the first or second aspects of the invention or their embodiments, or vice versa.

According to a fourth aspect of the present invention there is provided a method of moving a work string in a borehole comprising the steps of:

providing at least one downhole borehole traction apparatus comprising:

a body comprising a borehole engaging section;

wherein the borehole engaging section comprises an outer surface with at least one thread wherein the at least one thread comprises;

a crest surface;

a leading surface; and a trailing surface having a curvilinear shape;

wherein the crest surface and the leading surface are configured to engage the inner surface of the borehole to urge the apparatus along the inner surface of the borehole in response to rotation of the body and/or apparatus;

connecting the at least one downhole borehole traction apparatus to a work string;

rotating the work string to move the borehole engaging section to engage the inner surface of the borehole to urge the apparatus along the inner surface of the borehole in response to rotation of the body and/or the apparatus.

The method may comprise rotating the work string to rotate the at least one thread such that the at least one thread grips the wellbore.

Preferably the borehole engaging section comprises a plurality of threads to form a threaded profile or traction profile. The method may comprise rotating the work string to rotate the traction profile to bear against an inner wall of borehole to create a thrusting action to advance into the borehole in a downhole direction and/or provide an enhanced weight on bit transfer.

The work string may be a drill string. The method may comprise rotating the drill string to rotate the threaded profile such that the plurality of threads creates a force along the hole in a downhole direction on the drill string. The method may comprise rotating the drill string to rotate the threaded profile such that the plurality of threads transfer weight on bit.

The method may comprise connecting and/or arranging more than one downhole borehole traction apparatus to a work string.

Embodiments of the fourth aspect of the invention may include one or more features of the first to third aspects of the invention or their embodiments, or vice versa.

According to a fifth aspect of the present invention there is provided a method of moving a work string in a borehole comprising the steps of:

providing at least one downhole borehole traction apparatus comprising:

a body comprising a borehole engaging section;

wherein the borehole engaging section comprises an outer surface with at least one thread wherein the at least one thread comprises;

a crest surface;

a leading surface; and a trailing surface having a curvilinear shape;

wherein the crest surface and the leading surface are configured to engage the inner surface of the borehole and wherein the at least one thread has a low pressure generation means comprising one or more formations located upstream of the trailing surface;

connecting the at least one downhole borehole traction apparatus to a work string;

rotating the work string to move the borehole engaging section to engage the inner surface of the borehole to urge the apparatus along the inner surface of the borehole in response to rotation of the body and/or the apparatus.

The method may comprise rotating the work string to rotate the at least one thread such that the at least one thread grips the wellbore. The method may comprise rotating the work string to rotate crest surface and the leading surface of the at least one thread to grip the wellbore.

The method may comprise rotating the work string to create a zone of low pressure when well fluid flows over the at least one thread. The method may comprise rotating the drill string to create a flow of mud over the at least one thread to attract and/or recirculate drill cuttings.

The method may comprise cleaning or clearing the downhole borehole by rotating the work string to create a zone of low pressure to create a flow of mud over the at least one thread to attract and/or recirculate drill cuttings.

Embodiments of the fifth aspect of the invention may include one or more features of the first to fourth aspects of the invention or their embodiments, or vice versa.

According to a sixth aspect of the present invention there is provided a method of moving a work string in a borehole comprising the steps of:

providing at least one downhole borehole traction apparatus comprising:

a body comprising a screw member having a plurality of helical blades;

wherein each helical blade comprises;

a crest surface;

a leading surface; and a trailing surface having a curvilinear shape;

connecting the at least one downhole borehole traction apparatus to a work string;

rotating the work string to move the screw member to engage the inner surface of the borehole to urge the apparatus along the inner surface of the borehole in response to rotation of the body and/or the apparatus.

Embodiments of the sixth aspect of the invention may include one or more features of the first aspect of the invention or its embodiments, or vice versa.

According to a seventh aspect of the present invention there is provided a method of moving a drill string in a borehole comprising the steps of:

providing at least one downhole borehole traction apparatus comprising:

a body comprising a screw member having at least one helical blade for contacting the inner surface of the borehole;

wherein each helical blade comprises;

a crest surface;

a leading surface;

a trailing surface having a curvilinear shape;

connecting the at least one downhole borehole traction apparatus to a drill string;

rotating the drill string to move the screw member to engage the borehole thereby creating a thrust force on the apparatus along the borehole.

The method may comprise rotating the drill string to create a flow of mud over the at least one helical blade to recirculate drill cuttings.

The method may comprise rotating the drill string to create a thrust force on the apparatus in a generally downhole direction. The method may comprise rotating the drill string to create a low pressure zone on the at least one helical blade to recirculate the drill cutting and debris in the well bore.

Embodiments of the seventh aspect of the invention may include one or more features of the first to sixth aspects of the invention or their embodiments, or vice versa.

According to an eighth aspect of the present invention there is provided a downhole stabiliser apparatus comprising:

a body comprising a borehole engaging section;

wherein the borehole engaging section comprises an outer surface with at least one thread wherein the at least one thread comprises;

a crest surface;

a leading surface; and a trailing surface having a curvilinear shape;

wherein the crest surface and the leading surface are configured to engage the inner surface of the borehole to urge the apparatus along the inner surface of the borehole in response to rotation of the body and/or apparatus.

The stabiliser apparatus may be configured to be connectable to a work string. The stabiliser apparatus may comprise at least one blade. The borehole engaging section may be comprised of at least one blade. The borehole engaging section may be located on an outer surface of the at least one blade. The at least one thread may be located on an outer surface of the at least one blade. The stabiliser apparatus may comprise a plurality of blades. The borehole engaging section may be located on an outer surface of each blade.

According to a ninth aspect of the present invention there is provided drill string or work string component comprising:

a body comprising a borehole engaging section;

wherein the borehole engaging section comprises an outer surface with at least one thread wherein the at least one thread comprises;

a crest surface;

a leading surface; and a trailing surface having a curvilinear shape;

wherein the crest surface and the leading surface are configured to engage the inner surface of the borehole to urge the apparatus along the inner surface of the borehole in response to rotation of the body and/or component.

Embodiments of the ninth aspect of the invention may include one or more features of the first to eighth aspects of the invention or their embodiments, or vice versa.

According to a tenth aspect of the invention, there is provided a downhole stabiliser comprising the downhole borehole traction apparatus according to the first aspect of the invention.

Embodiments of the tenth aspect of the invention may include one or more features of any of the first to ninth aspects of the invention or its embodiments, or vice versa.

According to an eleventh aspect of the invention, there is provided a polycrystalline diamond (PDC) gauge section comprising the downhole borehole traction apparatus according to the first aspect of the invention.

Embodiments of the eleventh aspect of the invention may include one or more features of any of the first to tenth aspects of the invention or its embodiments, or vice versa.

According to a twelfth aspect of the present invention there is provided a downhole borehole traction apparatus comprising:

a body comprising a borehole engaging section;

wherein the borehole engaging section comprises an outer surface with at least one thread wherein the at least one thread comprises;

a crest surface;

a leading surface; and a trailing surface;

wherein the at least one thread has one or more formations configured to create a region of low pressure on or adjacent to at least one surface of the at least one thread.

The one or more formations may be configured to generate the region of lower pressure in downhole fluid due to relative movement occurring between the one or more formations and the downhole fluid.

Embodiments of the twelfth aspect of the invention may include one or more features of any of the first to eleventh aspects of the invention or its embodiments, or vice versa.

According to a thirteenth aspect of the present invention there is provided a downhole borehole traction apparatus comprising:

a body comprising a screw member having a plurality of helical blades;

wherein each helical blade comprises a helix angle of less than 30 degrees;

wherein the screw member is configured to engage the inner surface of the borehole to urge the apparatus along the inner surface of the borehole in response to rotation of the body.

Embodiments of the thirteenth aspect of the invention may include one or more features of any of the first to twelfth aspects of the invention or its embodiments, or vice versa.

According to a fourteenth aspect of the present invention there is provided a downhole borehole traction and cleaning apparatus comprising:

a body comprising a borehole engaging section;

wherein the borehole engaging section comprises an outer surface with at least one thread wherein the at least one thread comprises;

a crest surface;

a leading surface; and a trailing surface having a curvilinear shape;

wherein the crest surface and the leading surface are configured to engage an inner surface of the borehole to urge the apparatus along the inner surface of the borehole in response to rotation of the body and/or apparatus.

Embodiments of the fourteenth aspect of the invention may include one or more features of any of the first to thirteenth aspects of the invention or its embodiments, or vice versa.

BRIEF DESCRIPTION OF THE DRAWINGS

There will now be described, by way of example only, various embodiments of the invention with reference to the following drawings (like reference numerals referring to like features) in which:

FIG. 10 is a developed elevation view of a thread configuration of the helix sections of the downhole traction apparatus module of FIG. 1A;

DETAILED DESCRIPTION OF PREFERRED EMBODIMENTS

Figure 1A:
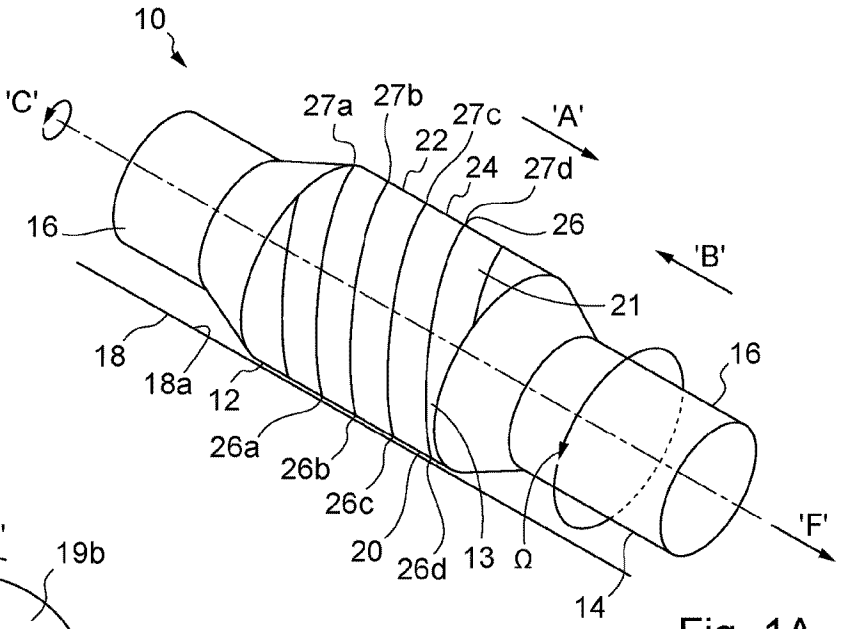
FIG. 1A is a perspective view of a downhole traction apparatus module in accordance with an embodiment of the invention.

FIG. 1A shows a first embodiment of a downhole traction apparatus module 10 in the form of a sub 12. The sub 12 has a generally cylindrical body 13 provided with suitable threaded couplings at each end to allow it to be connected to a work string.

In this example the coupling is a standard API certified pin connection 14 and box screw threaded connection 16 at either end to enable the sub 12 to be included in a work string (not shown) such as a drill string (not shown).

Although in this example the downhole traction apparatus module is described as being connectable to a work string such as a drill string it will be appreciated that it could be integrated into a work string component. It will also be appreciated that multiple downhole traction apparatus modules may be connected on the same work string or drill string.

In-use the pin connection 14 is located at the vertically lower most end such that the pin connection 14 is positioned closest to the drill bit (not shown) and the box connection 16 is positioned closest to the surface. In alternative embodiments the box connection may be the vertically lower most end.

Figure 1E:
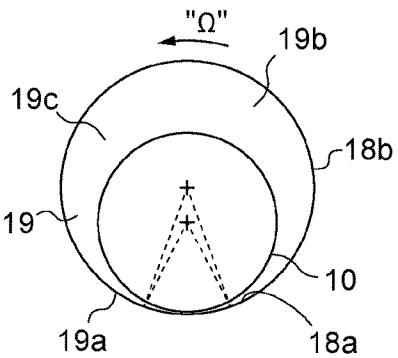
FIG. 1E is a schematic end view of the downhole traction apparatus module located on a work string in a wellbore.

In this example, the sub 12 is advanced into the borehole 18 in the direction of arrow "A" as shown in FIG. 1A and the direction of the drilling mud and cutting flow in the annulus towards the surface as indicated by arrow "B" in FIG. 1A. As shown in FIG. 1E the sub 12 lies on low side 19*a* of the wellbore annulus due to gravity. Depending on the dimensions of the annulus and the sub, there may be an annulus space 19*c* on the high side 19*b* of the annulus 19.

The sub 12 has a wellbore engaging section 20 which has a generally cylindrical core 21 with an outer surface 22 with a thread profile 24 which acts a traction profile. In this example the thread profile is formed from a plurality of helical blades 26 located on the outer surface 22. The blades 26 may be fixed to or integral with the outer surface 22.

The threaded profile has a plurality of threads 27 which extend in a helical form along the length of the surface 22. In this example shown in FIG. 1A, four blades 26*a*, 26*b*, 26*c* and 26*d* are arranged on the wellbore engaging section forming four threads 27*a*, 27*b*, 27*c* and 27*d*. The threads 27 have a selected thread height, axial pitch, and a profile which enables the screw to engage the formation without scarring or digging into the formation.

Figure 1B:
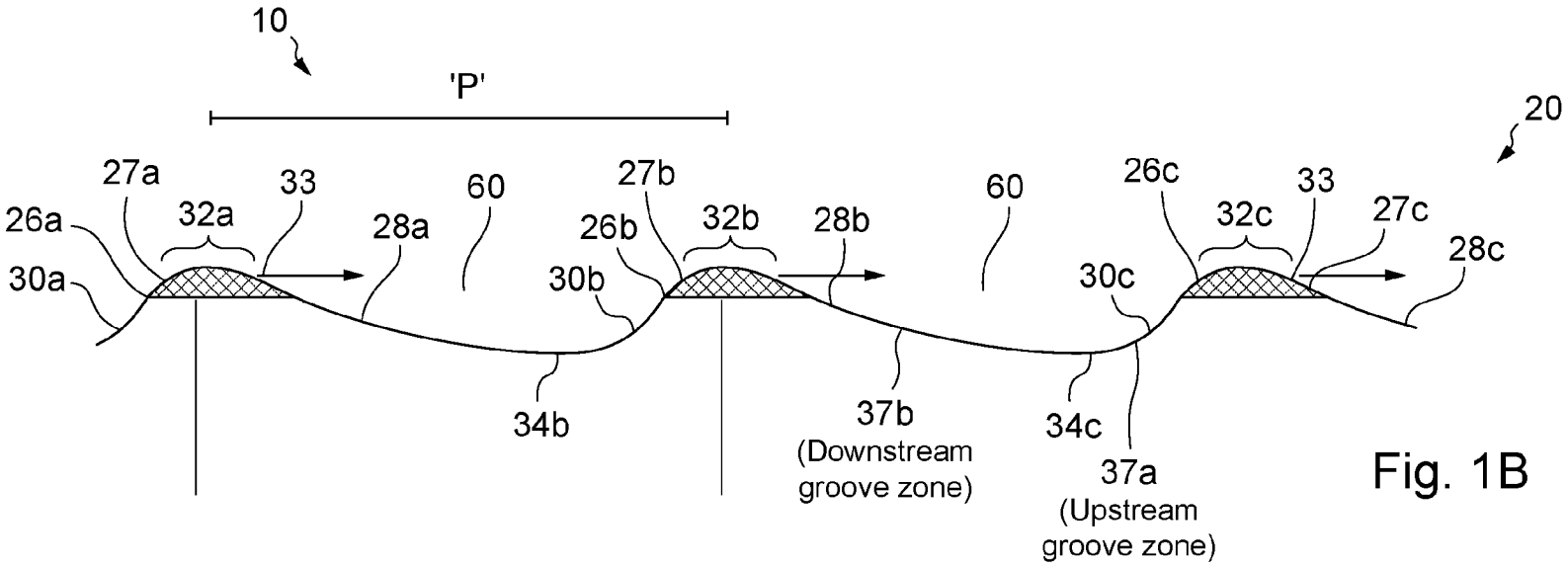
FIG. 1B is an enlarged longitudinal cross section of the threads of the helix section of FIG. 1A.
Figure 1C:
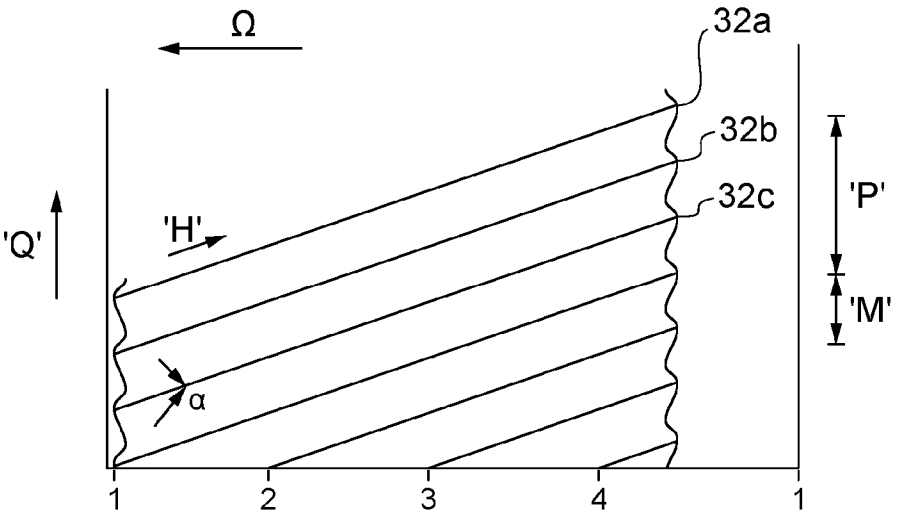
FIG. 1D is an enlarged profile view of two adjacent blades of the helix section of FIGS. 1A and 1B.

FIG. 1B shows an enlarged longitudinal cross-section of three adjacent blades in the wellbore engaging section 20. The profiles of the three blade threads 27*a*, 27*b* and 27*c* are shown.

Each of the threads 27*a*, 27*b*, 27*c* is asymmetrical with a leading surface 30*a*, 30*b*, 30*c*, a trailing surface 28*a*, 28*b*, 28*c*, a crest surface 32*a*, 32*b* and 32*c* and a thread root 34*a*, 34*b*, 34*c* respectively. Each of the threads are parallel along the helix angle direction "H". The leading surface 30*a*, 30*b* and 30*c* is the surface of the thread which first makes contact with the bore wall. The leading surface and trailing surface are asymmetric opposing curvilinear surfaces which flank the crest surface.

Figure 1D:
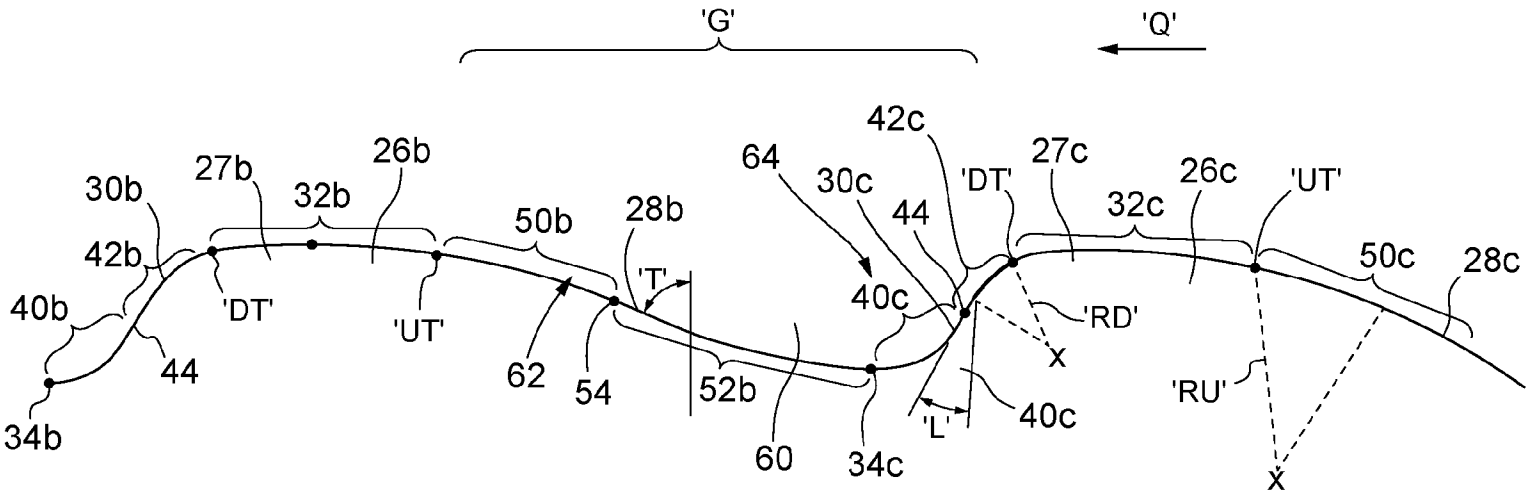

As best shown in FIG. 1D, each leading surface 30*b* and 30*c* has a first thread zone 40*b*, 40*c* and a second thread zone 42*b*, 42*c*. The first thread zone 40*b*, 40*c* has a surface which extends from the thread root 34*b*, 34*c* in a radially concave curvilinear shape to a tangent point 44 where the first thread zone meets and transitions into the second thread zone 42*b*, 42*c* where the outer surface of the leading surface 30*b* and 30*c* has a convex curvilinear shape.

The leading surface 30*b*, 30*c* has a leading angle of less than 70 degrees to the vertical shown as "L" in FIG. 1D. The trailing surface has a trailing angle "T" greater than the leading angle which results in a gentle sloping leading surface to assist in the low friction passage of the sub in the wellbore and a greater inclined leading surface to assist in the high efficiency traction of the crest surface and the generation of thrust force "F" as the sub in rotation around longitudinal axis "C" (shown in FIG. 1A).

In this example the leading angle is approximately 45 degrees. However, in certain embodiments the lead angle may range from between 30 to 80 degrees.

The crest surface 32*b* and 32*c* is generally a flat curvilinear shape to prevent the crest surface of the blade from cutting into or scaring the mud cake of the inner surface 18*a* of the borehole 18. The shape of the crest surface provides contact pressure distribution control. It will be appreciated that the crest surface may have other shapes including a convex shape for optimised pressure contact distribution. The shape of the crest surface provides controlled pressure distribution between the traction apparatus and the bore wall.

The blade crest surface 32*b*, 32*b* is the outer most diameter of the blades and the sub 12. The crest surface 32*b*, 32*c* is provided with a relatively hard facing material such as steel to be hard wearing to increase the life of the blades and therefore the sub 10.

As best shown in FIG. 1D, the crest surface 32*b*, 32*c* has a downstream tangential point "DT" where the second thread zone 42*b*, 42*c* meets and transitions into the crest surface 32*b*, 32*c*. The curve of the downstream tangential point has a tangential radius "RD". The crest surface 32*b*, 32*c* has an upstream tangential point "UT" where the crest surface 32*b*, 32*c* meets and transitions into the trailing surface 28*b*, 28*c*. The curve of the upstream tangential point has a tangential radius "RU". The tangential radius "RD" is generally lower than the tangential radius "RU".

The trailing surface 28*b*, 28*c* consists of a third thread zone 50*b*, 50*c* and a fourth zone 52*b*, 52*c*. The surface of the third thread zone 50*b*, 50*c* extends from the upstream tangential point "UT" in a radially convex curvilinear shape to a tangent point 54 where the third thread zone 50*b*, 50*c* meets and transitions into the fourth thread zone 52*b*, 52*c*. The fourth thread zone 52*b*, 52*c* has a surface which extends from the tangent point 54 in a radially concave curvilinear shape to the thread root 34*b*, 34*c*.

Between each of the blade threads 27*b*, 27*c* is a thread groove 60 having a groove width "G". The groove 60 is formed from the trailing surface of a first blade thread and the leading surface of an adjacent blade. The groove 60 extends from the upstream tangential "UT" point of one blade to the downstream tangential "DT" point of an adjacent blade. In use, the leading surfaces and crest surfaces of the threads form a wellbore traction section which bears against the surface of the wellbore. During rotation of the sub 12 a combination of forces is generated between wellbore traction section and the formation which encourages the sub 12 grip the formation and move the sub in the wellbore. As the sub 12 is rotated about its longitudinal axis "C" shown in FIG. 1A, the blades engage the inner surface 18*a* of the wellbore providing traction and resulting in a thrust force acting on the sub 12 in direction "F" shown in FIG. 1A. The thrust force moves the sub 12 and connected work string moving further downhole in direction "A" shown in FIG. 1A. If the work string is a drill string the thrust force provides weight on bit. It will be appreciated that reversal of the rotation direction may result in a thrust force in an opposing direction to direction "F".

The blades have a helix pitch "P", a lead "L" and a helix angle "α" as best shown in FIGS. 10 and 1D. The size of the helix angle α of the thread is determined by the outer diameter of the screw thread, the thread pitch and the thread height.

The helix angle in this example is 20 degrees to provide a gentle helix and prevent the screw from digging into the surrounding wellbore. It will be appreciated that the helix angle may range from 5 to 40 degrees. Preferably the helix angle is less than 30 degrees thus generating a maximum axial traction force The combination of different convex and concave surfaces of the leading surface and the trailing surfaces creates a high pressure zone 62 and a low pressure zone 64 in each of the grooves 60 when fluid flow moves in direction Q over and/or through the grooves 60. The sudden and drastic increase in the axisymmetric mud flow passage over the convex and concave surfaces of the leading surface and the trailing surfaces creates the high pressure zone 62 and a low pressure zone 64 in each of the grooves 60.

In this example the Archimedes screw is a right-hand screw (same direction as Ω) with right hand blades forming right hand flow channel. Alternatively the Archimedes screw may be a left-hand screw with left hand blades forming left hand flow channels.

Figure 2:
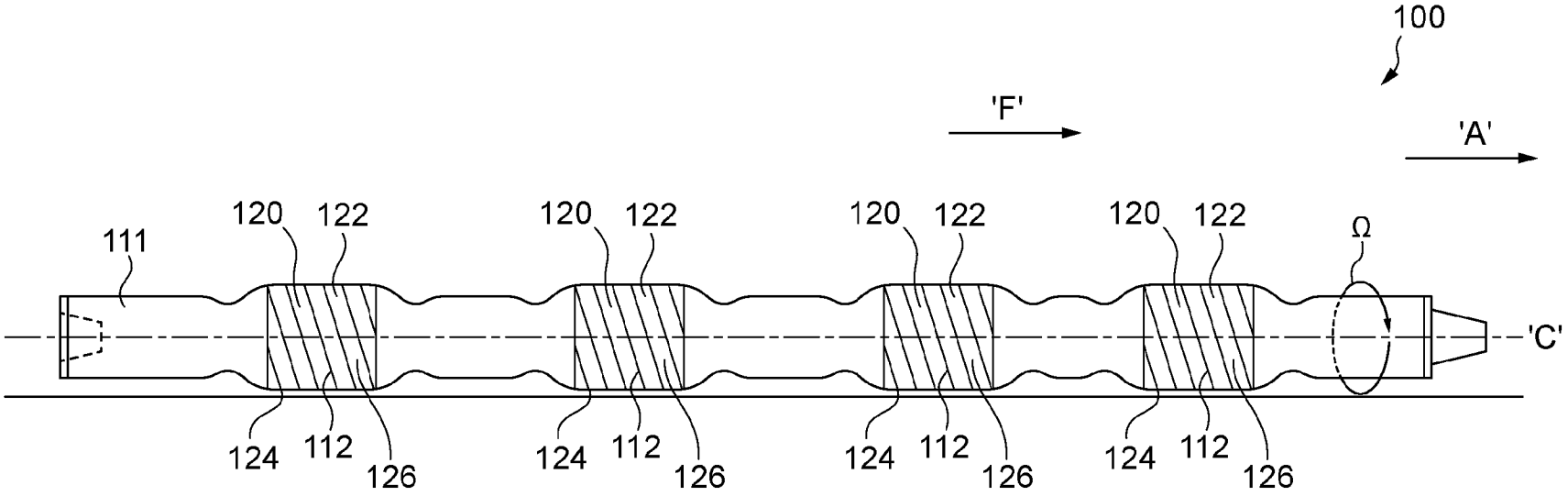
FIG. 2 shows a side view of a work string component with four downhole traction apparatus modules of FIG. 1A connected.

FIG. 2 shows a work string section 100 with four traction modules 112 in the form of subs 112. The traction module subs 112 are similar to the sub 12 described in FIGS. 1A to 1E above and will be understood from the above description of FIGS. 1A to 1E. Each of the traction modules 112 has a generally cylindrical body 113 provided with suitable threaded couplings to allow it to be connected to the work string 111. The sub 112 has a wellbore engaging section 120 which has a generally cylindrical core with an outer surface with a thread profile 124 formed from a plurality of helical blades 126 located on the outer surface 122. The blades 126 may be fixed to or integral with the outer surface 122.

Although in the above examples the modules are described as being threadedly connectable to the drill string or work string component, they may alternatively or additionally be integral with the drill string or a drill string component. Additional or alternatively the wellbore engaging section 120 may be integral with the drill string, a drill string component or a surface of drill string component thereof. In this example, the sub 112 is therefore advanced into a bore in the direction of arrow "A" as shown in FIG. 2.

The outer diameter wellbore engaging section 120 is preferably arranged to be the greatest diameter or at least equal to the greatest diameter of any other component included in the work string, such that the outer surface of the wellbore engaging section is the larger outer diameter of the whole of the work string to make contact with the inner surface of the borehole.

Figure 3A:
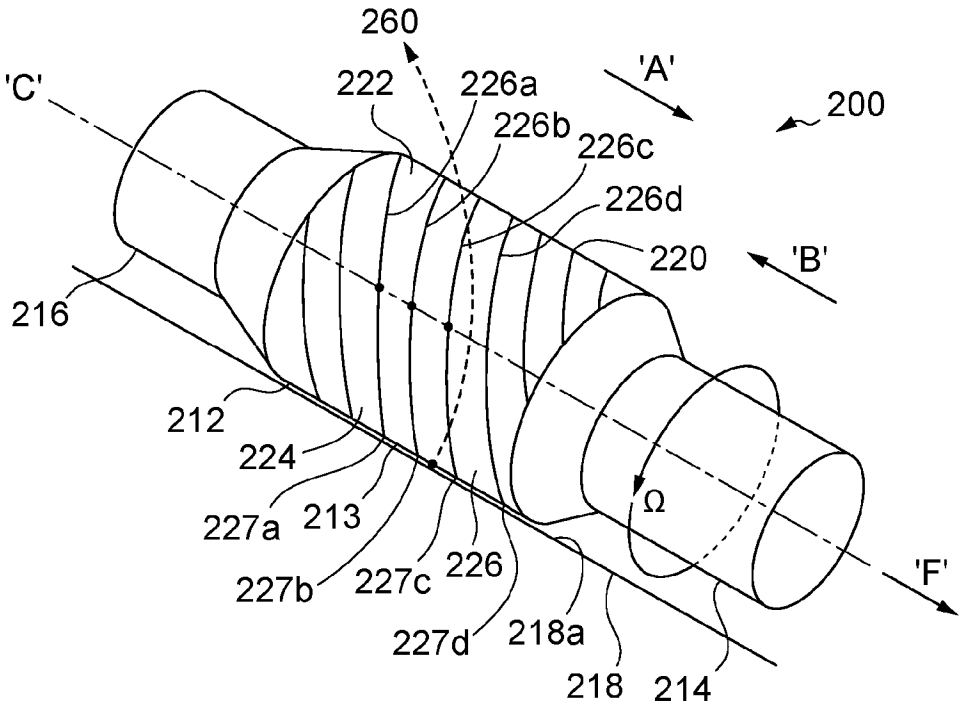
FIG. 3A shows a perspective view of a downhole traction apparatus module in accordance with an embodiment of the invention.

As the sub 112 is rotated from surface in the rotational direction shown as Ω in FIG. 2 about its longitudinal axis "C" (rotated at the surface in the clockwise direction) the blades engage the inner surface of the bore wall in an wellbore traction zone which includes the crest surface and the leading surface providing traction and resulting in a thrust force acting on each sub 12 in direction "F" shown in FIG. 2. The thrust force moves the sub 112 and connected work string 111 further downhole in direction "A" shown in FIG. 2. FIG. 3A shows a traction sub apparatus module 200 according to an embodiment of the invention. The sub module 200 is similar to the sub module 12 described in FIGS. 1A to 1E above and will be understood from the above description of FIGS. 1A to 1E. However the leading surface of the sub apparatus module in FIG. 3A comprises a recessed cavity or pocket on the leading surface to assist in the creation of a low pressure zone in the groove adjacent to leading surface to entrain and recirculate debris from the low side 19*a* of the wellbore annulus to the high side 19*b* of the annulus 19.

The sub 200 has a generally cylindrical body 213 provided with suitable threaded couplings to allow it to be connected to a drill string. In this example the coupling is a standard API certified pin connection 214 and box screw threaded connection 216 at either end to enable the sub 200 to be included in a drill string (not shown) such as a drill string (not shown).

In-use the pin connection 214 is located at the vertically lower most end such that the pin connection 214 is positioned closest to the drill bit (not shown) and the box connection 216 is positioned closest to the surface. In alternative embodiments the box connection may be the vertically lower most end nearest the drill bit (not shown) and the box connection 216 is positioned closest to the surface.

In the example, the sub 200 is therefore advanced and pushed into the borehole 218 in the direction of arrow "A" as shown in FIG. 3A and the direction of the drilling mud and cutting flow in the annulus towards the surface as indicated by arrow "B" in FIG. 3A.

The sub 212 has a wellbore engaging section 220 which has a generally cylindrical core 221 with an outer surface 222 with threaded profile 224 formed from a plurality of helical blades 226 located on the outer surface 222. The blades 226 may be fixed to or integral with the outer surface 222.

The blades 226 form threads 227 which extend in a helical form along the length of the surface 222. In the example shown in FIG. 3A, four blades 226*a*, 226*b*, 226*c*, 226*d* are arranged in a helical threaded arrangement on the wellbore engaging section forming four threads 227*a*, 227*b*, 227*c*, 227*d*. The threads 27 have a selected thread height, axial pitch, and a profile which enables the screw to engage the formation without scarring or digging into the formation.

Figure 3B:
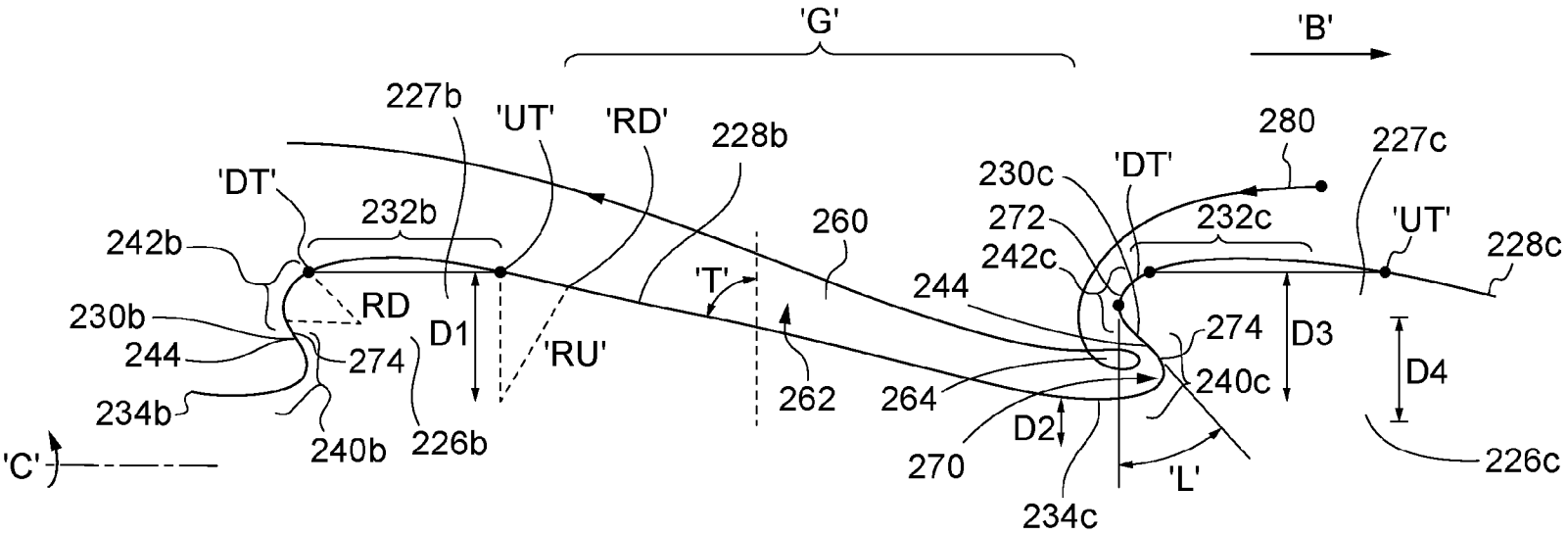
FIG. 3B is an enlarged profile view of two blades on the helix section of FIG. 3A.

FIG. 3B shows an enlarged axial cross-section of two adjacent blades 226*b* and 226*c* in the wellbore engaging section 220. The profiles of the two blade threads 227*b* and 227*c* are shown.

Each of the blade threads 227*b*, 227*c* are non-axisymmetrical with a leading surface 230*b*, 230*c*, a trailing surface 228*b*, 228*c*, a crest surface 232*b*, 232*c* and a thread root 234*b*, 234*c* respectively. All design elements follow the same helix angle α.

The leading surface 230*b*, 230*c* is the surface of the blade thread which first makes contact with the bore wall as the work string rotates. The leading surface and trailing surface are asymmetric opposing curvilinear surfaces which flank the crest surface.

Figure 3C:
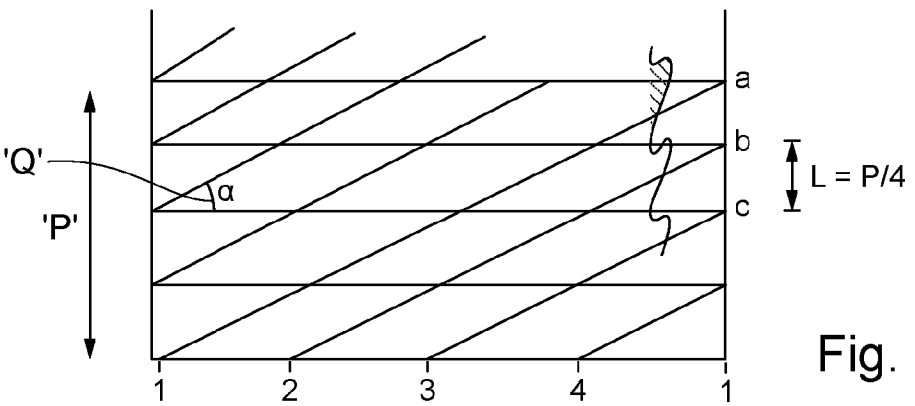
FIG. 3C is a developed elevation view of the thread of the four blades in the helix section of FIG. 3A.

As best shown in FIG. 3C, each leading surface 230*b*, 230*c* has a first thread zone 240*b*, 240*c* and a second thread zone 242*b*, 242*c*. The first thread zone 240*a* has a surface which extends from the thread root 234*b*, 234*c* in a radially concave curvilinear shape to a tangent point 244 where the first thread zone meets and transitions into the second thread zone 242*b*, 242*c* where the outer surface of the leading surface 230*b* and 230*c* has a convex curvilinear shape.

The concave curvilinear shape of the first thread zone 240*b*, 240*c* forms a recessed cavity 270 adjacent to the thread root 234*b*, 234*c*. The recessed cavity creates a zone of low pressure 264 as flow passes over the crest surface and blade trailing surface in the groove 260 followed by a sudden increase in groove flow passage.

The leading surface 230*b*, 230*c* has a leading angle of less than 45 degrees to the vertical shown as "L" in FIG. 1D. The trailing surface has a trailing angle "T" greater than the leading angle which results in a gentle sloping leading surface to assist in the low friction passage of the sub in the wellbore and a greater inclined leading surface to assist in the high efficiency traction of the crest surface and leading surface and the generation of thrust force "F" as the sub in rotation around longitudinal axis "C".

In this example the leading angle is from 45 degrees. However, in certain embodiments the lead angle may range from between 10 to 80 degrees.

The crest surface 232*b* and 232*c* is generally a flat curvilinear shape to prevent the crest surface of the blade from cutting into or scaring the mud cake of the inner surface 218*a* of the borehole 218. The shape of the crest surface provides contact pressure distribution control. It will be appreciated that the crest surface may have other shapes including convex or quadratic shapes to secure adequate tangential radius at contact surface between thread crest and bore wall.

The blade crest surface 232*b* and 232*b* is the outer most diameter of the blades and the sub 212. The crest surface 232*b* and 232*c* is provided with a relatively hard facing material such as steel to be hard wearing to increase the life of the blades and therefore the sub 200. The crest surface is provided with hard materials directly on the apparatus body The crest surface 232*b*, 232*c* has an downstream tangential point "DT" where the second zone 242*b*, 242*c* meets and transitions into the crest surface 232*b*, 232*c*. The curve of the downstream tangential point has a tangential radius "RD". The crest surface 232*b*, 232*c* has an upstream tangential point "UT" where the crest surface 232*b*, 232*c* meets and transitions into the trailing surface 228*b*, 228*c*. The curve of the upstream tangential point has a tangential radius "RU". The tangential radius "RD" is generally lower than the tangential radius "RU".

The trailing surface 228*b*, 228*c* consisting of a third thread zone 250*b*, 250*c* and a fourth thread zone 252*b*, 252*c*. The surface of the third thread zone 250*b*, 250*c* extends from the upstream tangential point "UT" in a radially convex curvilinear shape to a tangent point 254 where the third thread zone 250*b*, 250*c* meets and transitions into the fourth thread zone 252*b*, 252*c*. The fourth thread zone 252*a* has a surface which extends from the tangent point 254 in a radially concave curvilinear shape to the thread root 234*b*, 234*c* In other words the trailing surface 228*b*, 228*c* has a tapering or curvilinear convex contour shaped outer surface and which tapers from a first diameter D1 near the crest surface to a second diameter D2 near the thread root 234*b*, 234*c*.

Between each of the blade threads 227*b*, 227*c* is a thread groove 260 having a groove width "G". The groove 260 is formed from the trailing surface of one blade thread and the leading surface of an adjacent blade. The groove 260 extends from the upstream tangential "UT" point of one blade to the downstream tangential "DT" point of an adjacent blade.

In other words, the leading surface 230*b*, 230*c* rapidly narrows or tapers in its outer diameter between the maximum outer diameter D3 at a first end of the blade leading surface to a narrower outer diameter D4, where the angle of the transition portion of the outer surface the crest surface curves very sharply forming a shoulder 272. The crest surface curves sharply from being parallel with the longitudinal axis of the apparatus 200 to being substantially perpendicular or deeply inclined to the longitudinal axis of the apparatus forming the shoulder 272.

The blade leading surface 230*b*, 230*c* then leads into a substantially rectilinear portion which forms the recessed cavity 270. The recessed cavity comprises an inclined surface 274 which can be considered to be inclined at a negative angle with respect to the direction of arrow B of FIG. 3B. The inclined surface 274 continues to curve from being substantially perpendicular to the longitudinal axis "C" of the sub 200 to be inclined at a negative angle in the region of 45 degrees to the perpendicular (with respect to the longitudinal axis "C).

The inclined angle surface 274 has a substantial or majority of its length at an angle of around negative 45 degrees to the perpendicular in a direction "B" with respect to the radially outwards pointing direction and so can be considered around a 45 degrees back angle.

The angle of the inclined surface 274 between the substantially parallel (with respect to the longitudinal axis "C") outer surface of the crest surface and inclined surface is around 45 degrees.

The inclined surface 274 then leads into a lower leading surface which sharply curves back around through the perpendicular such that it heads back in the downstream direction. The lower leading surface has the majority of its outer surface lying at a positive angle of between 60 and 30 degrees to the perpendicular with respect to the longitudinal axis "C" of the sub 200 in an upstream direction (shown as "B" in FIG. 3*b*) with reference to the radially outwards pointing direction. Thus the leading surface has a serpentine cross section.

The outer diameter of the recessed cavity 270 on each blade changes very rapidly in a relatively short longitudinal length of the sub 200 and indeed due to the negative back angle, a pocket of low pressure is formed when flow passes over the recessed cavity. The low pressure is produced by a sudden and drastic increase in the flow passage.

The recessed cavity is therefore comprised of a combination of rectilinear (particularly the inclined surface 274 and curvilinear portions (particularly the first end of the blade leading which forms shoulder 272), and it is this geometry that enable the generation of an area of low pressure at the recessed cavity. The recessed cavity comprises an axisymmetric cavity which causes a low pressure is produced by a sudden and drastic increase in the axisymmetric flow passage. The recessed cavity comprises a serpentine or helically orientated shaped recess.

In use, the leading surfaces and crest surfaces of the threads form a wellbore traction section which bears against the surface of the wellbore. During rotation of the sub 212 a combination of forces are generated between wellbore traction section and the formation which encourages the sub 212 move in a downhole direction. As the sub 212 is rotated about its longitudinal axis "C" shown in FIG. 3A, the blades engage the inner surface 318*a* of the wellbore providing traction and resulting in a thrust force acting on the sub 312 in direction "F" shown in FIG. 1A. The thrust force moves the sub 312 and connected work string moving further downhole in direction "A" shown in FIG. 3A. If the work string is a drill string the thrust force provides weight on bit.

Fluid flow over the threads 227 and through the grooves 260 passes over the recessed cavity 270 which creates an low pressure zone 264 which attracts drill cuttings coming from the upstream cutting action and debris and drill cuttings on the low side 19*a* of the borehole 318 to be stirred and recirculated within the recessed cavity and the low pressure area.

Downstream of the recessed cavity the flow passes from the leading surface of the blades past the thread root and along the gradually tapering outer surface of trailing surface of the blades.

Drill cuttings suspended in and carried by drilling mud will flow along flow path 280 from the upstream end of the sub 200, around the crest surface of each blade and within the groove 260 of each blade, turbulently displaced or moved and therefore recirculated within the low pressure area created by the recessed cavity 270 and along the trailing face of the adjacent blade. In addition, drill cuttings that are already sedimented on a bed on the lower surface of the wellbore may be recirculated by the low pressure zone created by the recessed cavity 270 and scooped into the groove 260 between the blades and along the trailing face of the adjacent blade. In addition this cutting recirculation effect is enhanced and energised by the Archimedean screw effect, thus providing a powerful conveyor belt effect.

The blades have a helix pitch "P", a lead "L" and a helix angle "Q" as best shown in FIG. 3C. The helix angle is preferably less than 30 degrees to provide a gentle helix and prevent the screw from digging into the surrounding wellbore.

Figure 4:
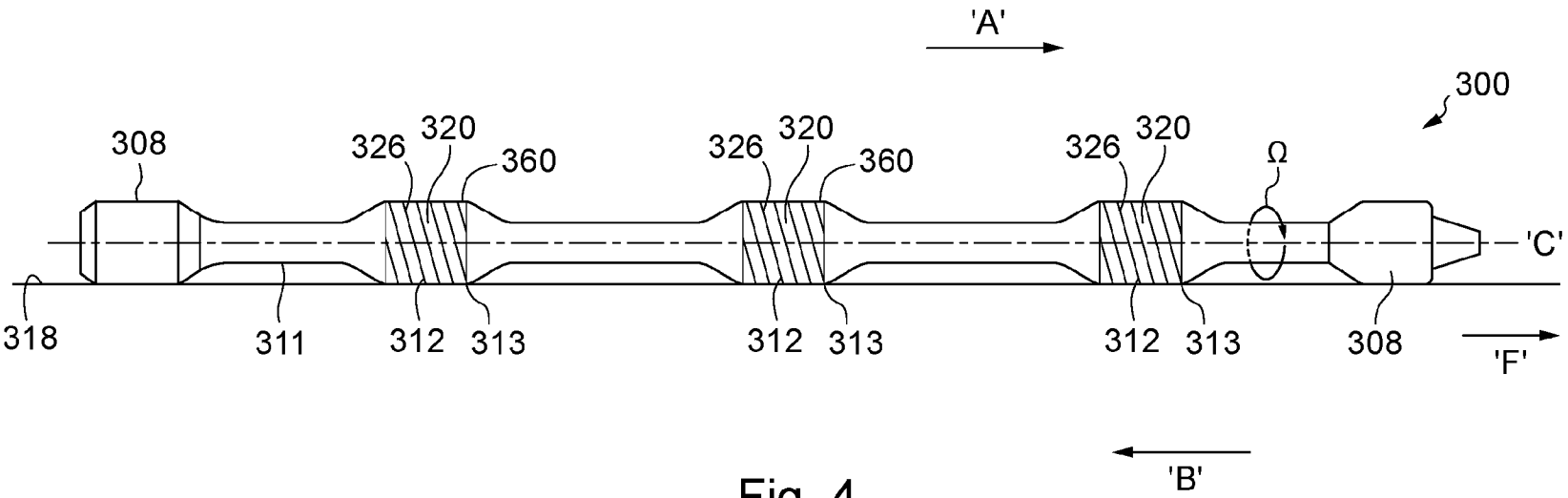
FIG. 4 is a side view of a work string component with three downhole traction apparatus modules of FIG. 3A integrated in to a drill sting.
Figure 7:
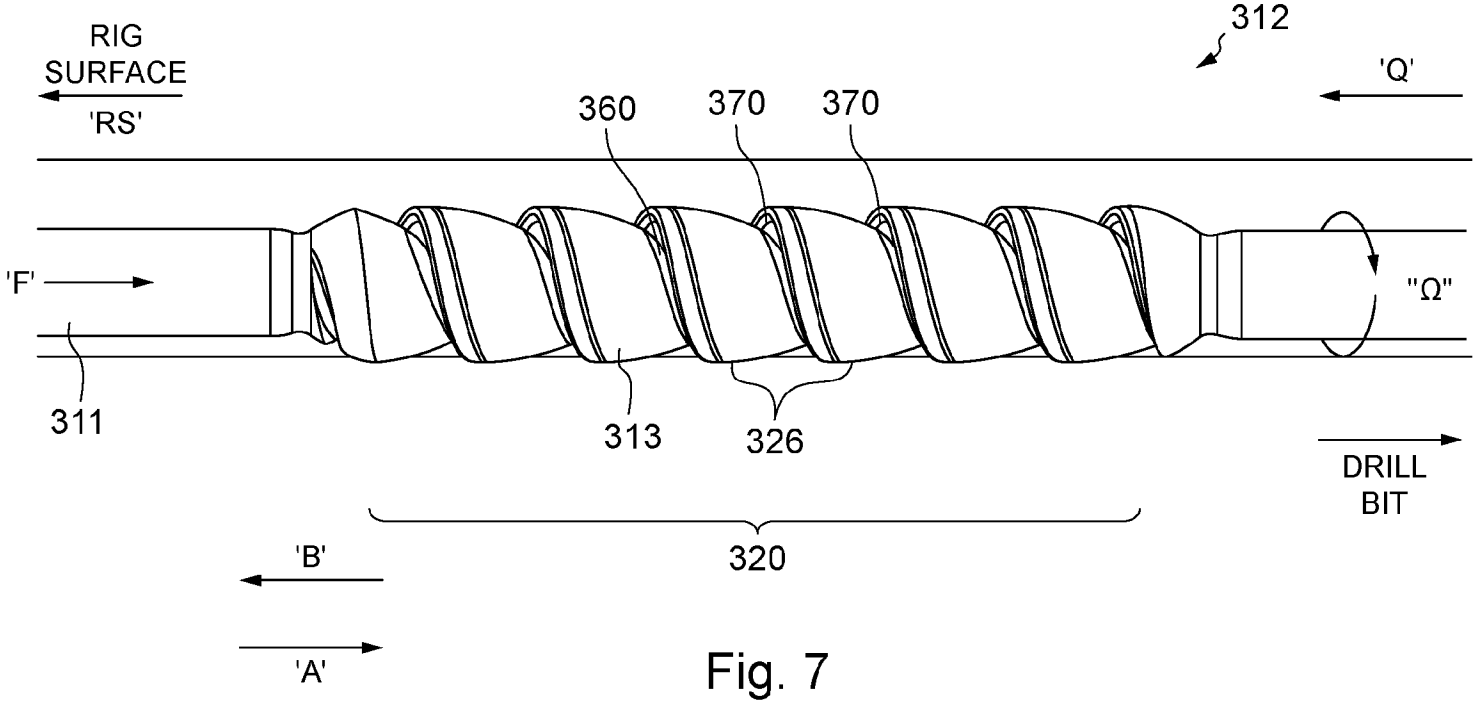
FIG. 7 is an enlarged side view a downhole traction apparatus module of FIG. 4.

FIG. 4 shows a drill string section 300 with tool joints 308 and three traction subs 312. FIG. 7 shows an enlarged view of one of the three traction subs 312. The traction sub modules 312 are similar to the sub 200 described in FIGS. 3A to 3C above and will be understood from the above description of FIGS. 3A to 3C. Each of the traction subs 312 has a generally cylindrical body 313 provided with suitable threaded couplings to allow it to be connected to the work string 311. In this example, as best shown in FIG. 7 each traction sub has seven blades 326. It will be appreciated the traction sub may have more or less than seven blades.

In use the drill string section 300 with three traction subs 312 is advanced into a bore in the direction of arrow "A" as shown in FIG. 4. As drill string 300 is rotated from surface in the rotational direction omega (Ω) about its longitudinal axis "C" (rotated at the surface in the clockwise direction) the blades 326 of the wellbore engaging section 320 of each sub 312 engage the inner surface of the bore wall providing traction and resulting in a thrust force acting on each sub 312 in direction "F" shown in FIG. 4. The thrust force moves the drill string section 300 and sub 312 and connected drill string 311 further downhole in direction "A" shown in FIG. 4.

As the drill bit (not shown) penetrates further downhole drilling mud flowing in the annulus in the direction "B" flows along the grooves between the blades in the Archimedes screw in the wellbore engaging section 320 of each sub. Fluid flow through the grooves 360 promotes movement of any drill cuttings resting on the low side of the annulus or flowing in the direction "B".

The low pressure area created by the recessed cavity 370 on each of the blade threads attracts drill cuttings coming from the upstream cutting action and debris and drill cuttings on the low side of the borehole 318 and so will cause the drill cutting bed to be stirred, recirculated and directed through the grooves 260 to the high size of the borehole 318.

Figure 5A:
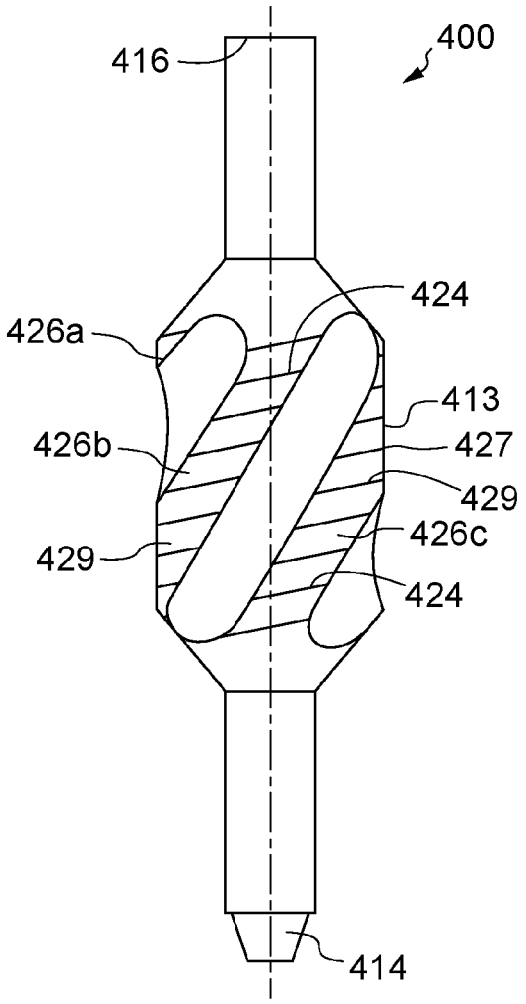
FIGS. 5A and 5B are side and end views of a stabiliser showing the traction profile zones on the blades on the stabiliser.
Figure 5B:
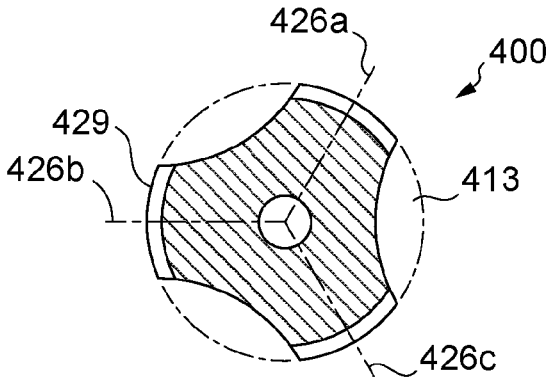

FIGS. 5A and 5B shows a stabiliser 400 with a generally cylindrical body 413 with suitable threaded couplings to allow it to be connected to a work string. In this example the coupling is a standard API certified pin connection 414 and box screw threaded connection 416 at either end to enable the sub 400 to be included in a work string (not shown) such as a drill string (not shown).

In-use the pin connection 414 is located at the vertically lower most end such that the pin connection 414 is positioned closest to the drill bit (not shown) and the box connection 416 is positioned closest to the surface. In alternative embodiments the box connection may be the vertically lower most end nearest the drill bit (not shown) and the box connection 416 is positioned closest to the surface.

The three equi-spaced blades 426*a*, 426*b*, 426*c* are peripherally mounted on the stabiliser body 413. The blades extend along the axial length of the body 413 in a helical configuration.

Figure 5C:
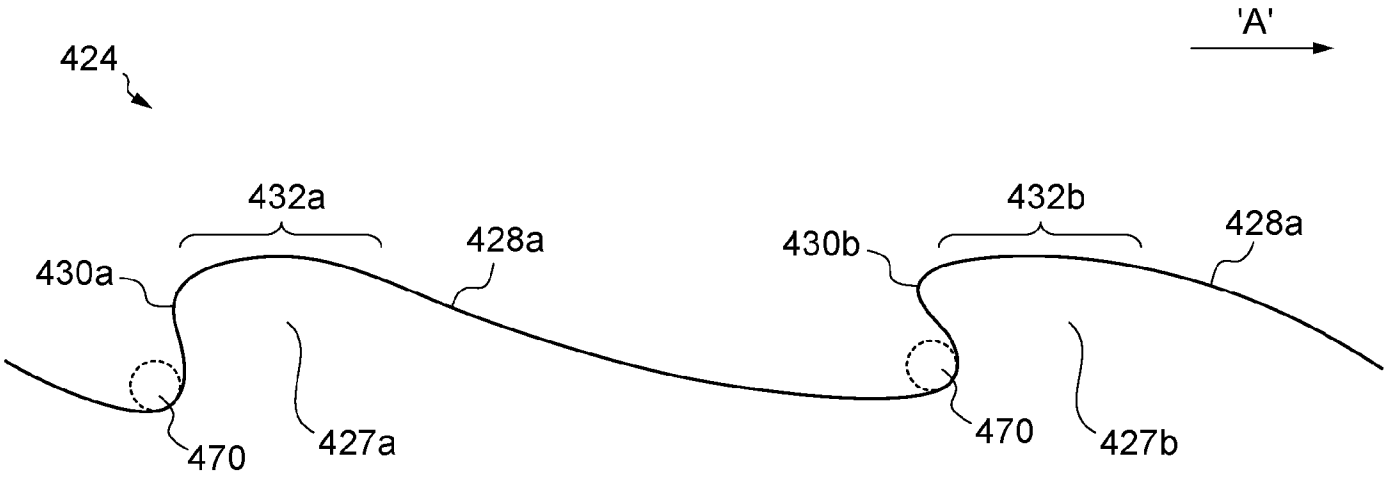
FIG. 5C shows an enlarged profile view of two threads of the traction profile of FIG. 5A.

As best shown in FIG. 5C the outer edge surfaces 429 of the blades 426 has a threaded profile 424 formed from a plurality of threads 427. The threaded profile acts as a traction profile and bears against the inner wall of borehole to create a thrusting action to advance into the borehole in the downhole direction shown as arrow "A" in FIG. 5C and/or provide an enhanced weight on bit transfer.

As shown in FIG. 5C each of the blade threads 427*a*, 427*b* is asymmetrical with a leading surface 430*a*, 430*b*; a trailing surface 428*a*, 428*b* a crest surface 432*a*, 432*b* and a thread root 434*a*, 434*b* respectively. Each of the threads have a low pressure zone created by a recessed cavity 470.

The threaded profile 424 is similar to the threaded profiles 24, 124, 224 in FIGS. 1A to 3C and will be understood from the descriptions of FIGS. 1A to 3C.

Figure 6:
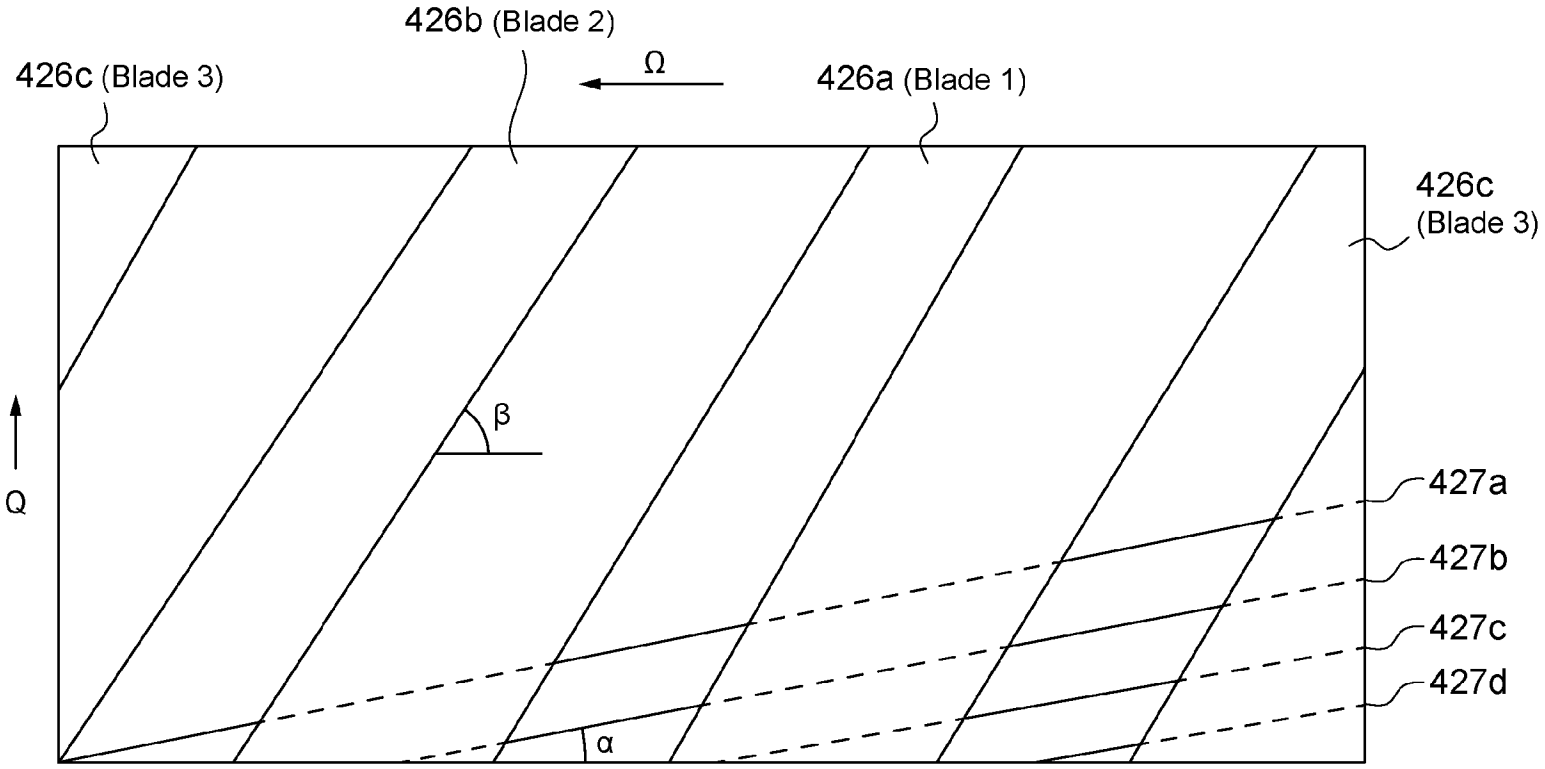
FIG. 6 is a developed elevation view of a traction profile zones on the blades of the work string stabilizer in FIGS. 5A and 5B.

FIG. 6 shows a developed elevation view of four helical threads 427*a*, 427*b*, 427*c* and 427*d* on the outer surface of the stabilizer blades 426*a*, 426*b*, 426*c*. The threads 427*a*, 427*b*, 427*c* and 427*d* have a selected thread height, axial pitch, and a profile which enables the stabiliser blades to engage the formation and provide a thrusting action.

The four helical threads are never parallel with the stabilizer blades 426*a*, 426*b*, 426*c*. The helix angle α of the four helical threads 427*a*, 427*b*, 427*c* and 427*d* is much smaller than the inclination angle β of the stabilizer blades 426*a*, 426*b*, 426*c*.

The thread profile (traction profile) including the crest surfaces and leading surfaces are made of hard materials or coated with hard materials and may act as stabilizer blade surface hard facing.

By providing a threaded profile with a general curvilinear geometry in combination with fluid bearing effect the rotational and axial stabilizer friction factors will drastically decrease reducing all static and dynamic loadings.

It will be appreciated that the traction profile may be incorporate into a range of work string component including PDC bit gauge sections and collars.

Although in the above examples the thread profile is formed from a plurality of blades it will be appreciated that the thread profile may be formed from a plurality of channels, grooves, ribs, ridges etc on a section of a work string component.

Although in the above embodiments the recessed cavity is described as being formed from an inclined surface having negative angle. It will be appreciated that the inclined surface could be modified to not actually require a negative back angle and instead the inclined surface could continue to be a positive angle of around 45 degrees because that may still provide some recirculation of drill cuttings in the drill cuttings bed but it is likely that it would not be as effective as the negative back angle of inclined surface as shown in FIG. 3A.

The invention provides a downhole borehole traction apparatus and method of use. The apparatus comprises a body comprising a borehole engaging section wherein the borehole engaging section comprises an outer surface comprising at least one thread. The at least one thread comprises a crest surface, a leading surface, and a trailing surface having a curvilinear shape. The at least one thread has a low pressure generation means comprising one or more formations.

The invention provides downhole traction apparatus which comprises a screw member having at least one helical blade for contacting the inner surface of the borehole. The least one helical blade comprises a helix angle of less than 30 degrees. The screw member is configured to engage the bore wall and generate thrust to displace the apparatus in a general downhole direction when the screw member is rotated.

The present invention in its various aspects provides an improved downhole traction apparatus and method of use. The invention provides a robust and reliable downhole traction tool which can provide a downhole traction force with low friction against the bore wall to mitigate damage to the bore wall with enhanced efficiency.

The invention also provides a downhole traction tool which can simultaneously provide traction to grip the wellbore traction and move drill cuttings settled on the lower side of the borehole thereby reducing the risk of loss of traction and the risk of drill string whirl.

The present invention may allow complete control over the movement of a downhole tool or equipment in a wellbore. The apparatus provides the operator with reliable control over the downhole movement of the apparatus by providing a traction apparatus capable of gripping and applying a traction force on the wellbore and clearing debris that may interfere with the ability to grip the wellbore The rotational movement required to grip and transport the apparatus in the wellbore is the same movement required to clear and/or recirculate the debris on a surface of the wellbore.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers.

Furthermore, relative terms such as, "lower", "upper, "up", "down", "above", "below", "downstream", "upstream" and the like are used herein to indicate directions and locations as they apply to the appended drawings and will not be construed as limiting the invention and features thereof to particular arrangements or orientations.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A downhole borehole traction apparatus comprising:

a body comprising a borehole engaging section, wherein the borehole engaging section comprises an outer surface configured to contact an inner surface of a borehole, wherein at least one thread is provided on the outer surface, and wherein the at least one thread comprises:

a crest surface;

a leading surface; and a trailing surface having a curvilinear shape;

wherein the at least one thread has a low pressure generation means comprising one or more formations; and wherein the crest surface of the at least one thread on the borehole engaging section is configured to engage an inner surface of the borehole.

2. The downhole borehole traction apparatus according to claim 1 wherein the crest surface and leading surface form a wellbore traction section configured to engage the inner surface of the borehole.

3. The downhole borehole traction apparatus according to claim 1 wherein the crest surface has a generally curve or flat surface.

4. The downhole borehole traction apparatus according to claim 1 wherein the one or more formations are located upstream of the trailing surface and downstream of the leading surface.

5. The downhole borehole traction apparatus according to claim 1 wherein the one or more formations are located adjacent to the leading surface.

6. The downhole borehole traction apparatus according to claim 1 wherein the leading surface and/or the trailing surface has a serpentine cross section.

7. The downhole borehole traction apparatus according to claim 1 wherein the one or more formations is a recess, cavity, pocket, concave or convex portion on the at least one thread.

8. The downhole borehole traction apparatus according to claim 1 wherein the leading surface has a direction angle equal to or less than 45 degrees.

9. The downhole borehole traction apparatus according to claim 1 wherein the one or more formations comprises a serpentine or helically orientated shaped recess.

10. The downhole borehole traction apparatus according to claim 1 wherein the at least one thread comprises a helix angle of less than 30 degrees.

11. The downhole borehole traction apparatus according to claim 1 wherein the borehole engaging section comprises an outer surface comprising a plurality of threads forming a threaded profile.

12. The downhole borehole traction apparatus according to claim 11 wherein the traction profile is incorporated into a range of work string components selected from PDC bit gauge sections, stabilisers and/or collars.

13. The downhole borehole traction apparatus according to claim 1 wherein the borehole engaging section comprises a screw member having a plurality of helical blades.

14. The downhole borehole traction apparatus according to claim 13 wherein a threaded profile is formed on an outer surface of each helical blade of the screw member.

15. The downhole borehole traction apparatus according to claim 1 wherein the borehole engaging section is configured to rotate about a longitudinal axis of the downhole borehole traction apparatus.

16. The downhole borehole traction apparatus according to claim 1 wherein the downhole borehole traction apparatus is connectable to a work string and/or a work string component.

17. The downhole borehole traction apparatus according to claim 1 wherein the downhole borehole traction apparatus is a unitary component.

18. The downhole borehole traction apparatus according to claim 1 wherein the downhole borehole traction apparatus is integral with a work string component and the borehole engaging section forms an outer surface of the work string component.

19. The downhole borehole traction apparatus according to claim 1 wherein the crest surface is the maximum outer diameter of the downhole borehole traction apparatus.

20. The downhole borehole traction apparatus according to claim 1 wherein the low pressure means is configured to allow the drill cuttings and debris in the wellbore to be attracted and recirculated.

21. A downhole work string component comprising the downhole borehole traction apparatus according to claim 1.

22. A method of moving a work string in a borehole comprising the steps of:

providing at least one downhole borehole traction apparatus comprising a body comprising a borehole engaging section, wherein the borehole engaging section comprises an outer surface configured to contact an inner surface of a borehole, wherein at least one thread is provided on the outer surface, and wherein the at least one thread comprises:

a crest surface;

a leading surface; and a trailing surface having a curvilinear shape;

wherein the at least one thread has a low pressure generation means comprising one or more formations;

connecting the at least one downhole borehole traction apparatus to a work string;

rotating the work string to move the borehole engaging section such that the crest surface of the at least one thread engages the inner surface of the borehole to urge the apparatus along the inner surface of the borehole in response to rotation of the body and/or the apparatus.

23. The method according to claim 22 comprising rotating the work string to rotate the borehole engaging section to bear against an inner wall of borehole to create a thrusting action to advance into the borehole in a downhole direction.

24. The method according to claim 22 comprising rotating the work string to rotate the borehole engaging section such that the at least one thread transfers weight on bit.

25. The method according to claim 22 comprising connecting and/or arranging more than one downhole borehole traction apparatus to a work string.

* * * * *